US006588402B2

(12) United States Patent
Price et al.

(10) Patent No.: US 6,588,402 B2
(45) Date of Patent: Jul. 8, 2003

(54) ENGINE WARM-UP OFFSETS

(75) Inventors: Stuart Graham Price, Kensington (AU); Keith Melbourne, Leederville (AU); Richard William Hurley, Glen Waverley (AU)

(73) Assignee: Orbital Engine Company (Australia) Pty Limited, Western Australia (AU)

( * ) Notice: Subject to any disclaimer, the term of this patent is extended or adjusted under 35 U.S.C. 154(b) by 0 days.

(21) Appl. No.: 10/124,258

(22) Filed: Apr. 18, 2002

(65) Prior Publication Data

US 2002/0112695 A1 Aug. 22, 2002

Related U.S. Application Data

(62) Division of application No. 09/147,481, filed as application No. PCT/AU97/00440 on Jul. 10, 1997.

(30) Foreign Application Priority Data

Jul. 10, 1996 (AU) ..... PO0952

(51) Int. Cl.[7] ..... F02M 51/00

(52) U.S. Cl. ..... 123/406.55; 123/491; 701/113

(58) Field of Search ..... 123/491, 406.55, 123/179.5, 179.1, 179.3, 179.15, 179.16, 576, 299, 300; 701/113

(56) References Cited

U.S. PATENT DOCUMENTS

| | | | | |
|---|---|---|---|---|
| 4,205,635 A | | 6/1980 | Kiru et al. | |
| 4,440,136 A | | 4/1984 | Denz et al. | |
| 4,476,817 A | | 10/1984 | Lindberg | |
| 4,765,301 A | * | 8/1988 | Koike et al. | 123/491 |
| 4,777,924 A | | 10/1988 | Fujimura et al. | |
| 4,928,642 A | | 5/1990 | Atkinson et al. | |
| 5,038,740 A | | 8/1991 | Tachibana et al. | |
| 5,060,618 A | | 10/1991 | Takaoka et al. | |
| 5,205,255 A | | 4/1993 | Yamagata et al. | |
| 5,400,755 A | | 3/1995 | Maebashi | |
| 5,482,017 A | * | 1/1996 | Brehob et al. | 123/299 |
| 5,507,265 A | * | 4/1996 | Ichikawa et al. | 123/478 |
| 6,032,653 A | * | 3/2000 | Anamoto | 123/491 |

FOREIGN PATENT DOCUMENTS

| | | | |
|---|---|---|---|
| DE | 3729-771 A | | 3/1989 |
| JP | 9-32604 | * | 2/1997 |

* cited by examiner

*Primary Examiner*—Mahmoud M Gimie
(74) *Attorney, Agent, or Firm*—Arent Fox Kintner Plotkin & Kahn, PLLC

(57) ABSTRACT

A method of controlling an internal combustion engine during a warm-up period thereof including controlling at least one operational parameter of the engine as a function of at least a certain measure of the energy delivered to the engine since the start of the warm-up period of the engine to thereby provide improved combustion stability during said warm-up period. Preferably, the measure of the energy delivered to the engine is based on the amount of fuel delivered to the engine during the warm-up period.

41 Claims, 3 Drawing Sheets

IGNITION

START OF AIR

APC

EXHAUST VALVE

ENGINE WARM-UP OFFSETS

Figure 1:
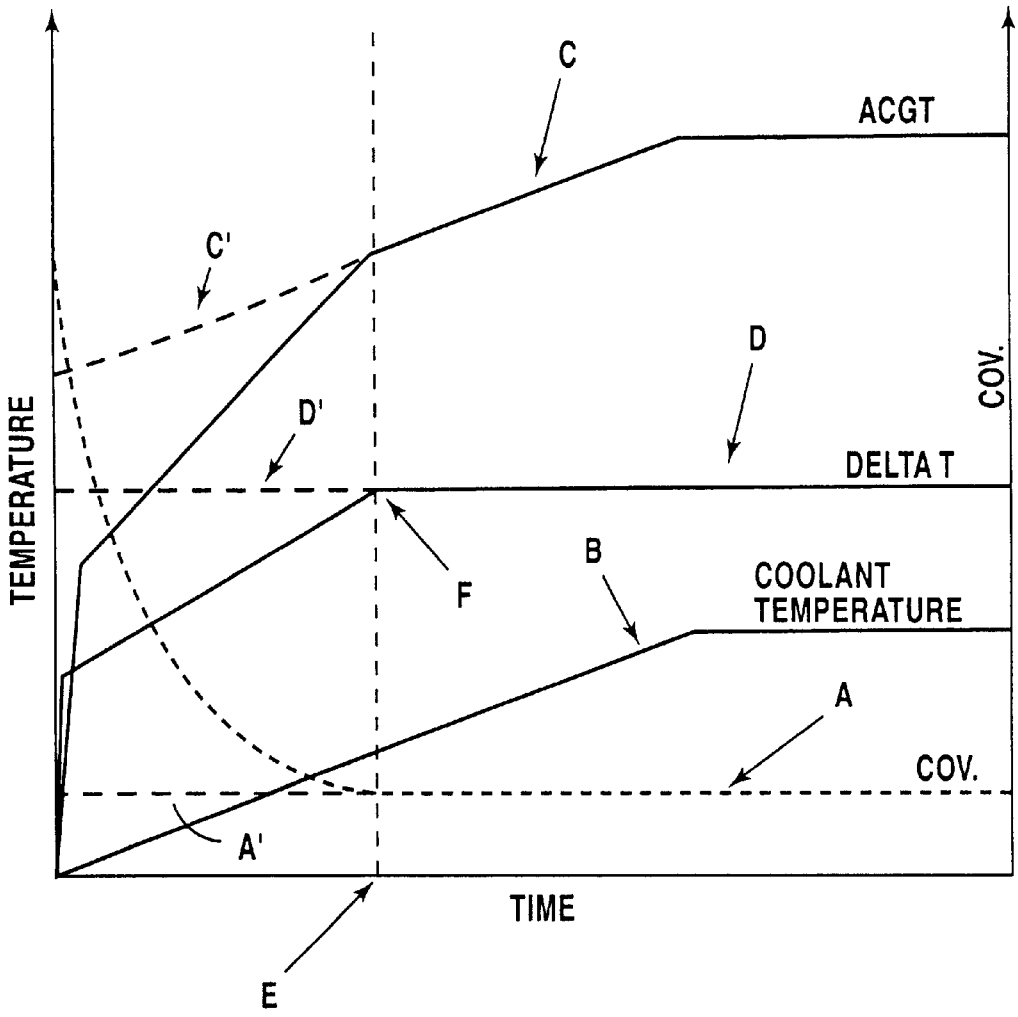

This is a Division of application Ser. No. 09/147,481 filed Jan. 7, 1999, which is a 371 of PCT/AU97/00440 filed Jul. 10, 1997.

The present invention generally relates to a method for controlling an internal combustion engine, and is in particular related to the control of such an engine during the warm-up period thereof.

Internal combustion engines typically exhibit relatively poor combustion stability during a warm-up period therefor, and particularly following a cold start of the engine whilst it is at a very low temperature. The combustion stability generally improves as the engine warms up towards its normal operating temperatures. In some engines which are controlled by an engine management system under the control of an electronic control unit (ECU), a warm-up period is defined as the initial operation of the engine until it reaches a predetermined engine operating temperature.

The combustion stability within the engine can be indicated by a coefficient of variance (COV) value. This COV value provides an indication of the degree of variation of the gross indicated torque within each cylinder of the engine. The gross indicated torque is directly related to the peak pressures within each cylinder and may graphically be represented by the area beneath a cylinder pressure trace. Variations in the gross indicated torque generally arise as a result of unstable combustion within each cylinder and hence the COV value is essentially a measure of how stable the engine is running. Typically, a decrease in the COV value would indicate an improvement in the combustion stability of the engine.

It is known practice, particularly in four-stroke engines, to try to improve the combustion stability during the engine warm-up period by running the engine using a richer than usual air/fuel mixture and/or by advancing the ignition timing during this period. These operating parameters have generally been controlled manually or automatically as a function of the engine coolant temperature during the warm-up period. However, tests conducted by the Applicant on it's direct injected engines have shown that there is no direct correlation between the coolant temperature and the degree of combustion stability for certain types of engines. For example, if an engine at start-up having a coolant temperature of say 20 degrees Celsius is compared to the same engine which had previously been started whilst having a lower coolant temperature and which had since been running for a period of time such that the coolant temperature was now at 20 degrees Celsius, the COV value for each situation could well be very different even though the coolant temperature was now the same.

Tests conducted by the Applicant on certain engines reveal that the COV value of the engine typically progressively decreases following cold start-up of the engine during a warm-up period until it reaches an at least substantially constant value. This constant or steady state COV value is generally the same as the COV value of the engine when the engine is running at normal operating temperatures (ie: the engine has effectively warmed up and a satisfactory level of combustion stability has been achieved).

During the warm-up period, both the average cylinder gas temperature (ACGT) within each combustion chamber of the engine and the temperature of the engine coolant progressively increase. The coolant temperature typically rises as a result of energy transfer in the form of heat from the combustion chambers and cylinder walls to the coolant passages of the engine. It has been found that with steady state running conditions after a period of time following start-up, the temperature difference between the ACGT and the coolant temperature becomes at least substantially constant. This may occur even while the combustion and coolant temperatures continue to increase. The point at which this temperature difference first reaches this substantially constant value generally corresponds to the point at which the COV reaches its low steady state value.

Accordingly, it is desired that certain engine operating parameters are modified during the warm-up period such that the ACGT increases so that the temperature difference between the combustion and coolant temperatures under steady state operating conditions attains the constant value referred to above. This would typically lead to the COV value being the same low steady state value as it would under normal running conditions which in turn would effectively result in the achievement of acceptable combustion stability during the warm-up period. This constant COV value would be achievable across any operating conditions.

Further to the above comments, the Applicant has noted that, for a particular engine configuration started from a given coolant temperature, whilst the time to achieve satisfactory combustion stability may differ depending upon engine operating conditions and more generally how the engine is run following start-up, substantially the same level of energy is always put into the engine to attain this satisfactory combustion stability. This energy is placed into the engine by the combustion of fuel within each combustion chamber of the engine during the warm-up period and therefore the amount of fuel delivered to the engine since start-up correlates to the amount of energy delivered to the engine since start-up. That is, for a particular configuration of engine, the point at which the abovementioned temperature difference and COV value reach a constant value also correlates to a certain amount of fuel being delivered to the engine.

It therefore follows that there is a correlation between the amount of fuel supplied to the engine since start-up and the degree of combustion stability of the engine. To reiterate, the total amount of fuel supplied to the engine since start-up (referred to as the "accumulated fuel") required to reach the above noted low steady state COV value is substantially the same regardless of how long it takes to reach that point, provided that the engine at start-up has the same initial coolant temperature. It is therefore not relevant to the attainment of satisfactory stability whether the engine is operated at high speed or remains at idle until that point is reached as long as the same total amount of fuel from start-up is used.

Accordingly, it is possible to base the degree of offset or modification to individual engine operating parameters during the warm-up period on the accumulated fuel since start-up. That is, the offsets can be set on the basis of how much fuel has been delivered to the engine since start-up.

Alternatively, it should be noted that other means for estimating the amount of energy delivered to the engine during the warm-up period may be used. For example, the energy supplied to the engine may be estimated by way of an accumulated value of the load level of each combustion event during the warm-up period.

It is therefore an object of the present invention to operate with a low COV value during a warm-up period for an engine, this being achieved by the provision of operating parameter offsets based on a certain measure of the energy delivered to the engine during the warm-up period.

It is a further object of the present invention to operate with a low COV value during a warm-up period for an engine, this being achieved by the provision of operating parameter offsets based on the amount of fuel delivered to the engine during the warm-up period.

With this in mind, the present invention provides in one aspect a method of controlling an internal combustion engine during a warm-up period thereof including controlling at least one operational parameter of the engine as a function of at least a certain measure of the energy supplied to the engine during the warm-up period. Preferably, the at least one operational parameter of the engine is controlled as a function of at least the certain measure of energy supplied to the engine during the warm-up period of the engine to thereby provide improved combustion stability during said warm-up period.

Conveniently, control of the at least one operational parameter of the engine may be provided on the basis of a certain measure of the energy supplied to the engine during the warm-up period together with other factors related to the engine operation. For example, engine temperature and the certain measure of energy supplied to the engine during the warm-up period may together be used to control the at least one operational parameter of the engine. Further, in more complex models, other factors such as the energy last due to, for example, incomplete combustion of fuel or heat loss, may be taken account of.

Preferably, the measure of the energy supplied to the engine during the warm-up period is based on the amount of fuel delivered to the engine during the warm-up period.

Alternatively, the measure of the energy supplied to the engine during the warm-up period is based on an accumulated value of the load level of each combustion event during the warm-up period.

Conveniently, the coefficient of variance of the gross indicated torque during the warm-up period is maintained at a relatively low value. More preferably, the coefficient of variance of the gross indicated torque during the warm-up period is generally maintained at the same low constant or steady state value that would result from normal running of the engine subsequent to the warm-up period therefor.

Conveniently, control of the at least one operational parameter of the engine as a function of the total amount of fuel to be supplied to the engine during the warm-up period or an accumulated value of the load level of each combustion event during the warm-up period is also dependent upon an engine temperature at starting of the engine. Normally, the engine temperature is given by the coolant temperature thereof. As will be discussed further hereinafter, the initial engine coolant temperature aids in the determination of to what extent the at least one operational parameter is required to be modified during the warm-up period.

Conveniently, in regard to the operational parameter being controlled on the basis of the accumulation of an amount of fuel supplied to the engine, the warm-up period of the engine is that time taken for the predetermined amount of fuel to be supplied to the engine since the starting of the engine. Hence, the length of the warm-up period is dependant on the running conditions of the engine which essentially determine the time taken for the predetermined amount of fuel to be supplied to the engine. In this regard, it is important to note that the control method of the present invention does not necessarily seek to reduce the warm-up period for the engine. Rather, it recognises that a predetermined amount of fuel is required to be supplied to the engine to complete the warm-up period and uses this predetermined amount of fuel to accurately control at least one operational parameter of the engine to provide satisfactory combustion stability during the warm-up period. Further, the predetermined amount of fuel is also used to determine when accurately control of the at least one operational parameter of the engine in this way can cease.

Nevertheless, as compared to prior art warm-up strategies which rely on monitoring coolant temperature to determine when an engine is warm and hence when offsets on various operating parameters can be removed, the method of the present invention may indeed result in a shorter warm-up period. This is mainly due to the fact that the warm-up period is dependent upon the amount of fuel delivered to the engine and that the operating parameter offsets are able to be removed more accurately based on the delivery of this amount of fuel to the engine. Further, it may in fact be the case that the warm-up period is reduced due to the way in which the engine is operated during the warm-up period, even though the same predetermined amount of fuel is delivered to the engine.

Preferably, the at least one operational parameter of the engine is controlled only up to the time at which the predetermined amount of fuel has been supplied to the engine. Thereafter, the at least one operational parameter of the engine is controlled in the known manner under the ensuing engine operating conditions, typically on the basis of normal running maps.

Preferably, the predetermined amount of fuel to be supplied to the engine which defines to length of the warm-up period is determined by measurements and tests conducted on the engine.

Conveniently, the at least one operational parameter of the engine is controlled as a function of the total fuel supplied to the engine since the starting of the engine when the engine temperature is below a predetermined value. The engine temperature is typically given by the coolant temperature of the engine. Alternatively, the engine temperature may be based on the temperature of part of the engine itself, such as the block or the head, or may be based on the temperature of a specific component of the engine such as a head bolt or an inlet valve.

Further to the above, the method may more particularly include:

a) determining the total amount of fuel required to be supplied to the engine to complete the warm-up period, b) providing a warm-up map for the at least one operational parameter controlling the operation of the engine, c) selecting a scaling factor for the at least one operational parameter controlling the operation of the engine, the scaling factor being selected as a function of the actual amount of fuel supplied to the engine since the start of the warm-up period, and d) using the scaling factor to control the transition from the warm-up map to a normal running map for the at least one operational parameter controlling the operation of the engine.

As alluded to hereinbefore, the required total fuel amount to complete warm-up or the "total accumulated fuel" may be determined as a function of the engine temperature at the start of the warm-up period. Effectively, the engine temperature is used as a reference to the engine condition at the start of the warm-up period. To this end, the required fuel amount may be plotted against engine temperature in a "look-up" map provided by an electronic control unit (ECU). As alluded to hereinbefore, the engine temperature may typically be given by the coolant temperature but may alternatively be given by the temperature of, for example, the block, the head, a head bolt or an engine component.

Preferably, the warm-up map may comprise absolute values for the at least one operational parameter. These values are those required to achieve stable combustion at a predetermined start-up temperature which is significantly lower than the normal engine operating temperature. For example, the values in the start-up map may be based on achieving stable combustion at −10° C.

Conveniently, the scaling factor is applied to the difference between corresponding values in the warm-up map and the normal running map for certain engine speed and/or loads for the at least one operational parameter. Hence, reduction of the scaling factor by virtue of the increase in the amount of fuel supplied to the engine since start-up controls the transition from the warm-up map to the normal running map for the at least one operational parameter.

Control of the at least one operating parameter of the engine to provide for satisfactory combustion stability during the warm-up period essentially results in an increase in the average cylinder gas temperature ACGT within the or each combustion chamber of the engine and therefore a corresponding increase in the temperature difference between the ACGT and the coolant temperature of the engine. As alluded to hereinbefore, this temperature difference correlates to the coefficient of variance of the gross indicated torque for the engine and hence by achieving a substantially constant temperature difference, a low and substantially constant coefficient of variance can be achieved during warm-up. Importantly, the at least one operational parameter of the engine is controlled according to the method of the present invention immediately preceding cranking of the engine. That is, satisfactory combustion stability is typically achieved immediately the engine is started.

The operational parameters of the engine controlled according to the present invention may include the air supplied to the or each cylinder per engine cycle (APC), and hence the air/fuel ratio, and the ignition timing. Further, in respect of an engine comprising a dual fluid injection system such as that discussed in U.S. Pat. No. 4,934,329, the start of air injection (SOA) which determines the commencement of fuel delivery to the engine may be controlled. Still further, and particularly in regard to a two stroke engine such as those that have been developed by the Applicant, the position of the or each exhaust valve relative to the respective exhaust port of a cylinder may also be controlled. Notwithstanding the above, the control of other engine operating parameters according to the method as described are considered to be within the scope of the present invention.

The scaling factor for each of the above operational parameters may be determined as a function of the total accumulated fuel supplied to the engine. These functions may be mapped within respective look-up maps for each operational parameter. Depending on the engine temperature measured at the start of the warm-up period, the total amount of accumulated fuel required to complete warm-up may vary, typically decreasing with increasing initial engine temperature. Hence, the start point within each look-up map for the determination of the scaling factors may therefore be selected on the basis of the initial engine temperature. That is, the start point which determines the initial scaling factor to be applied to each operating parameter of the engine is based on the amount of fuel required to be delivered to the engine to complete the warm-up period.

The scaling factor for the above noted operating parameters may normally decrease from a maximum value at the start of the warm-up period to a minimum value at the end of the warm-up period. Therefore, at the end of the warm-up period, each operational parameter will have reached a value representative of its typical setting during normal operation of the engine.

A scaling factor may also be provided in respect of the control of the recirculation of exhaust gas, known as "EGR", to the engine combustion chambers. However, because EGR systems typically warm up more slowly than the rest of the engine, control of EGR may need to be based on a longer time frame than the other operational parameters of the engine. Furthermore, the control of EGR may be different to the other operational parameters in that the degree of EGR may always begin at a zero value at the start of the warm-up period and may progressively increase during and beyond the warm-up period of the engine to a required normal operating level. The period of time to reach this normal level may decrease with increasing initial engine temperature.

Whilst the above comments have been based on controlling the at least one operational parameter on the basis of the amount of fuel delivered to the engine during the warm-up period, it should be noted that similar comments apply in regard to controlling the at least one operational parameter on the basis of some other means which effectively correlates to the amount of energy delivered to the engine during the warm-up period.

It will be convenient to further describe the invention by reference to the accompanying drawings which illustrate a preferred embodiment of the invention. Other embodiments of the invention are possible and consequentially and, the particularity of the accompanying drawings is not to be understood as superseding the generality of the preceding description of the invention.

Figure 2A:
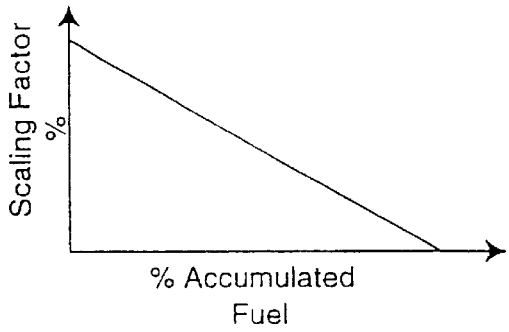
Figure 2B:
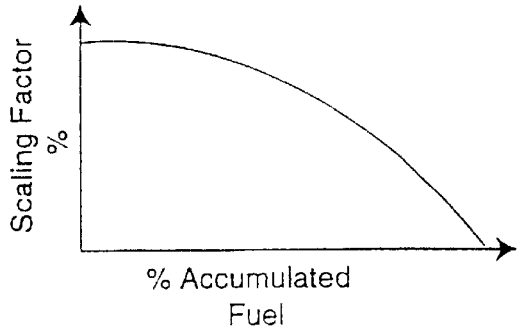
Figure 2C:
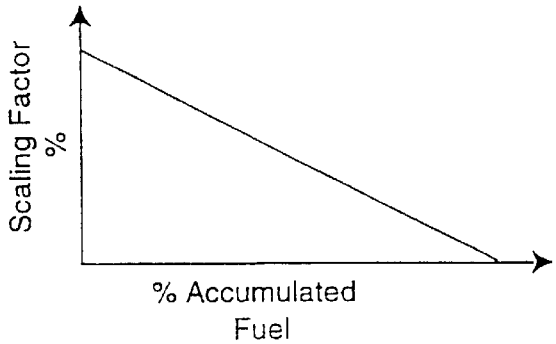
Figure 2D:
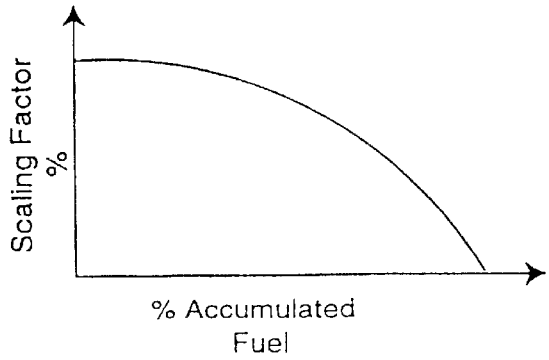
Figure 3:
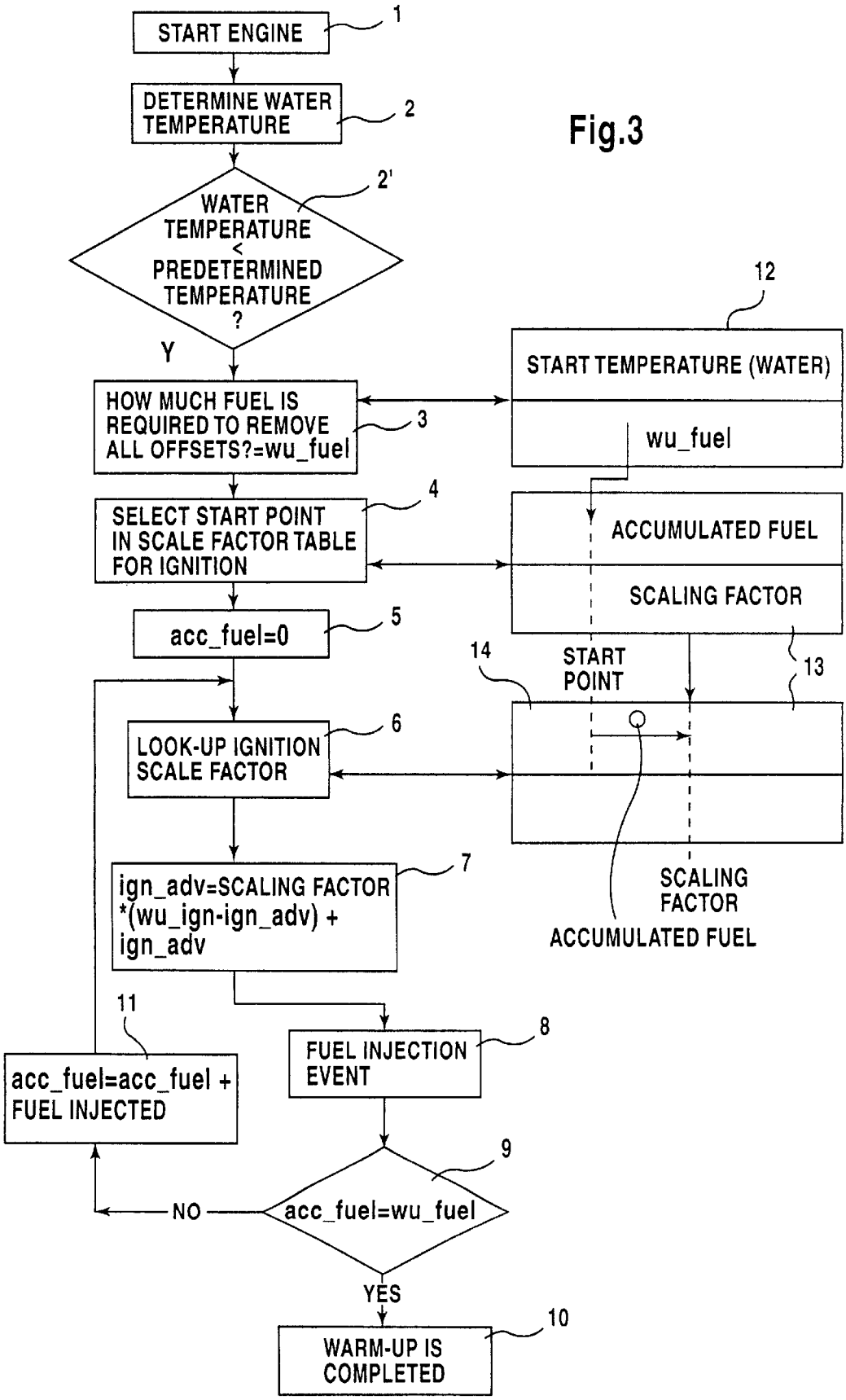

In the drawings:

FIG. 1 is a graph showing the correlation between the difference in temperature between the average cylinder gas temperature and engine coolant temperature and the co-efficient of variance of the gross indicated torque of the engine;

FIGS. 2*a* to 2*d* are graphs showing the scaling factors for different operational parameters of the engine as a function of the percentage of total accumulated fuel supplied to the engine within the warm-up period; and FIG. 3 is a flowchart showing a warm-up strategy according to the present invention when used to control the ignition timing.

Referring initially to FIG. 1, the graph plots a number of engine variables against time for a particular load and speed setting. Curve A represents the co-efficient of variance (COV) of the gross indicated torque of the engine following starting of the engine. As can be seen, immediately following start-up of the engine, the COV value is high representing relatively poor combustion stability within the engine. The COV value decreases as the engine warms up until it reaches a relatively low constant or steady state value. This occurs from around point E on the time scale onwards.

Curves B and C respectively represent the engine coolant temperature and the average cylinder gas temperature (ACGT) for the engine following start-up of the engine. Both of the above noted temperatures progressively increase following start-up of the engine until they reach a steady state value which would normally remain substantially constant under normal engine operating conditions. Curve D represents the temperature difference between the ACGT and the engine coolant temperature following start-up of the engine. It should be noted that at the point F on curve D, the temperature difference reaches a constant value, this constant value subsequently being maintained even while the ACGT and coolant temperature continue to increase. Also, point F corresponds with the time E at which the COV first reaches its relatively steady state value. This graph thus illustrates the correlation between the energy supplied to the engine resulting in the increase in the ACGT and coolant temperature, and the combustion stability of the engine.

The present invention seeks to control at least one operational parameter of the engine to essentially increase the ACGT as indicated by the curve C' to effectively maintain a substantially constant temperature difference between the ACGT and coolant temperature from the initial start-up of the engine until the time indicated by point E is reached. That is, the temperature difference indicated by the curve D' is endeavoured to be maintained. By maintaining this constant temperature difference, the COV during the warm-up period is represented by the curve A'. Accordingly, this is indicative of a satisfactory level of combustion stability during the warm-up period.

Further, it is to be noted that, in one embodiment, the point E is essentially representative of a predetermined amount of fuel having been delivered to the engine. Whilst the point E may vary, hence representing a different time to complete warm-up, the predetermined amount of fuel that would ultimately result in the constant COV value when no corrections or adjustments are required to the operational parameters of the engine would remain the same. This amount of required fuel remains the same regardless of the engine operating conditions (i.e. not limited to steady state conditions and is applicable where transients occur).

To achieve the desired stable combustion during the warm-up period, the operational parameters are varied from their normal absolute values by means of scaling factors. That is, as is well known in the control of engines, offsets are essentially provided to the operational parameters of the engine, typically for the duration of the warm-up period. In this regard and as mentioned hereinbefore, the scaling factor is applied to the difference between corresponding value in a warm-up map and a normal running map for the at least one operational parameter of the engine. As the amount of fuel supplied to the engine increases since the start-up of the engine, the transition from the values in the warm-up map to the corresponding values in the normal running map is controlled for the at least one operational parameter of the engine.

Looking for example at FIG. 2*a*, the graph shows the scaling factor for ignition timing as a function of the amount of fuel supplied to the engine following engine start-up during the warm-up period of the engine, also referred to as the "accumulated fuel". The scaling factor is typically scaled between 0 and 1, with the scaling factor being at a maximum at the start of the warm-up period. At this point, the method according to the present invention provides a significant advance to the timing of the ignition over the ignition timing typically used under normal operating conditions. During the warm-up period, as the accumulated fuel value increases, the scaling factor progressively decreases in a linear fashion relative to the accumulated fuel value. At the end of the warm-up period, the scaling factor reaches 0 such that the ignition timing would now be the timing typically used under normal engine operating conditions.

It must however be noted that the scaling factors are typically calculated on the assumption that the engine will be started whilst having a coolant temperature above a certain value, for example, −10° C. Accordingly, if for example, an engine is started whilst it has a coolant temperature of say, −20° C., the scaling factors applied during an initial portion of the warm-up period will be greater than 1. For example, the initial scaling factors immediately following start-up may be 1.5 and subsequently decrease as mentioned hereinbefore until reaching 0.

FIG. 2*b* is a similar graph showing the scaling factor for controlling the timing of the start of air injection (SOA), or essentially, the start of fuel injection to an engine having a dual fluid injection system, as a function of the accumulated fuel since start-up. Unlike the scaling factor for ignition timing, it has been found that the optimum scaling factor for the start of air injection follows a non-linear function relative to the accumulated fuel as clearly shown in FIG. 2*b*.

FIGS. 2*c* and 2*d* respectively show the scaling factors for the air supplied per cylinder per cycle, or "APC", and the exhaust valve position setting in a two stroke engine as a function of the accumulated fuel since start-up. As alluded to hereinbefore, other scaling factors for other engine operating parameters, such as for example, control of EGR, may be provided. In this regard, any appropriate relationship may be used to control an operating parameter on the basis of the percentage of accumulated fuel since start-up.

Referring to FIG. 3, there is shown a flowchart showing the warm-up strategy according to the present invention with respect to the ignition timing for the engine. A similar procedure may be used for the other operational parameters of the engine referred to above. At step 1 as shown in the flowchart, the start-up of the engine is commenced, typically by the turning of the ignition key. At step 2, the engine coolant temperature is determined. This coolant temperature is compared against a predetermined coolant temperature to ascertain whether the warm-up control strategy is required. For example, for coolant temperatures above say 80° C., the engine will not require to go through a warm-up routine where offsets are applied to various engine operating parameters, and so the engine will proceed to be controlled in accordance with normal operating conditions.

Provided that the warm-up routine is required, at step 3 the total amount of fuel required for the warm-up period of the engine (wu_fuel) is determined by referring to a look-up map 12 plotting total accumulated fuel against engine coolant temperature. Less total accumulated fuel for the warm-up period is required if the coolant temperature is higher.

At step 4, a start point 14 in a scale factor map for the ignition timing is selected. The scale factor map is provided in a second look-up map 13 which plots the scaling factors for the ignition timing against the total accumulated fuel supplied to the engine since engine start-up (acc_fuel). This look-up map 13 complies with the relationship between the ignition scaling factor and the total accumulated fuel as shown in FIG. 2*a*. The start point 14 within the look-up map 13 will vary depending on the amount of accumulated fuel required to complete warm-up (wu_fuel). The lesser the amount of accumulated fuel required, the further rightward the starting point will be as shown in the graph in FIG. 2*a*. Accordingly, this will result in the initial scaling factor used to determine an offset for the ignition timing being of the lower value.

At step 5, an electronic control unit of the engine controlling this procedure sets a counter adding the amount of the fuel supplied to the engine since start-up to 0. The actual commencement of the warm-up period for the engine begins at this time. At step 6, the ignition scale factor is obtained from the look-up map 13. At step 7, the actual ignition advance used by the engine at that stage of the warm-up period is determined according to the following function:

$$ign_adv = scaling\ factor * (wu_ign - ign_{_advn}) + ign_advn$$

wherein

"ign_adv" is the actual ignition advance to be used by the engine during the warm-up period;

"scaling factor" is the scale factor obtained from the ignition timing look-up map 13;

"wu_ign" is the ignition advance obtained from a warm-up map providing absolute values of the ignition timing calibrated against a predetermined coolant temperature; and "ign_adv" is the ignition timing obtained from a normal running map providing absolute values of the ignition timing used by the engine under normal operating conditions.

At step 8, the actual fuel injection event and associated ignition event at the calculated advance occurs. At step 9, the actual amount of fuel supplied to the engine (acc_fuel) is compared with the total accumulated fuel requirements (wu_fuel) obtained from look-up map 12. If the fuel amounts are the same, then the warm-up period is completed at step 10. Otherwise, the fuel injected at step 8 is added to the accumulated fuel value at step 11 by the counter of step 5 and the procedure is repeated from step 6.

Modifications and variations as would be known to the skilled addressee are deemed to be within the scope of the claims of the present invention.

What is claimed is:

1. A method of operating an internal combustion engine during a warm-up period, the method comprising:

determining a quantity of fuel to be supplied to said engine to complete said warm-up period; and controlling at least one operational parameter during said warm-up period to thereby provide combustion stability to said engine, wherein said quantity of fuel is independent of engine speed during said warm-up period.

2. The method according to claim 1, wherein said quantity of fuel is a cumulative amount of fuel supplied to at least one cylinder of said engine from start-up of said engine.

3. The method according to claim 1, wherein said quantity of fuel is dependent on at least one engine condition at starting of said engine.

4. The method according to claim 3, wherein said at least one condition is engine temperature.

5. The method according to claim 1, wherein said quantity of fuel is independent of engine operating conditions during said warm-up period.

6. The method according to claim 1, wherein said control of said at least one operational parameter is at least in part dependent on a cumulative measure of fuel supplied to the engine since start-up of the engine.

7. The method according to claim 1, wherein said at least one operational parameter is at least one of ignition timing, injection timing, exhaust gas recirculation rate, air per cycle, and air fuel ratio.

8. The method according to claim 7, wherein said engine has a dual fluid injection system and said injection timing comprises at least start of air injection.

9. The method according to claim 1, wherein said combustion stability is a low co-variance of gross indicated torque.

10. The method according to claim 9, wherein said low co-variance of gross indicated torque corresponds to a co-variance of indicated torque under steady state operating conditions of said engine.

11. A method of operating an internal combustion engine during a warm-up period, the method comprising:

determining a quantity of fuel to be supplied to said engine to complete said warm-up period; and controlling at least one operational parameter during said warm-up period to thereby provide combustion stability to said engine, wherein said quantity of fuel is dependent on at least one engine operating condition at starting of said engine, and wherein said quantity of fuel is independent of engine operating conditions during said warm-up period.

12. The method according to claim 11, wherein said control of said at least one operational parameter is at least, in part, dependent on a cumulative measure of fuel supplied to the engine since start-up of the engine.

13. The method according to claim 11, wherein said at least one operational parameter is at least one of ignition timing, injection timing, exhaust gas recirculation rate, air per cycle, and air fuel ratio.

14. The method according to claim 13, wherein said engine has a dual fluid injection system and said injection timing comprises at least start of air injection.

15. A method of operating an internal combustion engine during a warm-up period, the method comprising:

determining a quantity of fuel to be supplied to said engine to complete said warm-up period; and controlling at least one operational parameter during said warm-up period to thereby provide combustion stability to said engine, wherein said quantity of fuel is dependent on at least one engine condition at starting of said engine, and wherein said control of said at least one operational parameter is at least in part dependent on a cumulative measure of the fuel supplied to the engine since start-up of the engine.

16. The method according to claim 15, wherein said at least one operational parameter is at least one of ignition timing, injection timing, exhaust gas recirculation rate, air per cycle, and air fuel ratio.

17. The method according to claim 16, wherein said engine has a dual fluid injection system and said injection timing comprises at least start of air injection.

18. A method of operating an internal combustion engine during a warm-up period, the method comprising:

determining the quantity of fuel to be supplied to said engine to complete said warm-up period, wherein said quantity of fuel is dependent on at least one engine condition at starting of said engine;

supplying said quantity of fuel to said engine, wherein said quantity of fuel is independent of engine speed during said warm-up period.

19. The method according to claim 18, wherein said quantity of fuel is a cumulative amount of fuel supplied to at least one cylinder of said engine from start-up of said engine.

20. The method according to claim 18, wherein said quantity of fuel is independent of engine operating conditions during said warm-up period.

21. An electronic control unit programmed to control operation of an internal combustion engine at least from start-up of said engine by determining a quantity of fuel to be supplied to said engine to complete a warm-up period of operation for said engine and controlling at least one operational parameter during said warm-up period to thereby provide combustion stability to said engine, wherein said quantity of fuel is independent of engine speed during said warm-up period.

22. The electronic control unit according to claim 21, wherein said quantity of fuel is a cumulative amount of fuel supplied to at least one cylinder of said engine from start-up of said engine.

23. The electronic control unit according to claim 21, wherein said quantity of fuel is dependent on at least one engine condition at starting of said engine.

24. The electronic control unit according to claim 23, wherein said at least one condition is engine temperature.

25. The electronic control unit according to claim 21, wherein said quantity of fuel is independent of engine operating conditions during said warm-up period.

26. The electronic control unit according to claim 21, wherein said quantity of fuel is independent of a rate at which fuel is supplied to said engine during said warm-up period.

27. The electronic control unit according to claim 21, wherein said control of said at least one operational parameter is at least, in part, dependent on a cumulative measure of fuel supplied to the engine since start-up of the engine.

28. The electronic control unit according to claim 21, wherein said at least one operational parameter is at least one of ignition timing, injection timing, exhaust gas recirculation rate, air per cycle, and air fuel ratio.

29. The electronic control unit according to claim 28, wherein said engine has a dual fluid injection system and said injection timing comprises at least start of air injection.

30. The electronic control unit according to claim 21, wherein said combustion stability is a low co-variance of gross indicated torque.

31. The electronic control unit according to claim 30, wherein said low co-variance of gross indicated torque corresponds to a co-variance of indicated torque under steady state operating conditions of said engine.

32. An electronic control unit programmed to control operation of an internal combustion engine at least from start-up of said engine according to the steps of determining a quantity of fuel to be supplied to said engine to complete a warm-up period of operation for said engine and controlling at least one operational parameter during said warm-up period to thereby provide combustion stability to said engine, wherein said quantity of fuel is dependent on at least one engine condition at starting of said engine, and wherein said quantity of fuel is independent of engine operating conditions during said warm-up period.

33. The electronic control unit according to claim 32, wherein said control of said at least one operational parameter is at least, in part, dependent on a cumulative measure of fuel supplied to the engine since start-up of the engine.

34. The electronic control unit according to claim 32, wherein said at least one operational parameter is at least one of ignition timing, injection timing, exhaust gas recirculation rate, air per cycle, and air fuel ratio.

35. The electronic control unit according to claim 34, wherein said engine has a dual fluid injection system and said injection timing comprises at least start of air injection.

36. An electronic control unit programmed to control operation of an internal combustion engine at least from start-up of said engine according to the steps of determining a quantity of fuel to be supplied to said engine to complete a warm-up period of operation for said engine and controlling at least one operational parameter during said warm-up period to thereby provide combustion stability to said engine, wherein said quantity of fuel is dependent on at least one engine condition at starting of said engine, and wherein said control of said at least one operational parameter is at least in part dependent on a cumulative measure of fuel supplied to the engine since start-up of the engine.

37. The electronic control unit according to claim 36, wherein said at least one operational parameter is at least one of ignition timing, injection timing, exhaust gas recirculation rate, air per cycle, and air fuel ratio.

38. The electronic control unit according to claim 37, wherein said engine has a dual fluid injection system and said injection timing comprises at least start of air injection.

39. An electronic control unit programmed to control operation of an internal combustion engine at least from start-up of said engine by determining a quantity of fuel to be supplied to said engine to complete a warm-up period of operation for said engine, wherein said quantity of fuel is dependent on at least one engine condition at starting of said engine and supplying said quantity of fuel to said engine, and wherein said quantity of fuel is independent of engine speed during said warm-up period.

40. The electronic control unit according to claim 39, wherein said quantity of fuel is a cumulative amount of fuel supplied to at least one cylinder of said engine from start-up of said engine.

41. The electronic control unit according to claim 39, wherein said quantity of fuel is independent of engine operating conditions during said warm-up period.

* * * * *